US005293112A

United States Patent [19]

Takahashi

[11] Patent Number: 5,293,112

[45] Date of Patent: Mar. 8, 1994

[54] CONSTANT-CURRENT SOURCE

[75] Inventor: Norihito Takahashi, Yamagata, Japan

[73] Assignee: NEC Corporation, Tokyo, Japan

[21] Appl. No.: 917,422

[22] Filed: Jul. 23, 1992

[30] Foreign Application Priority Data

Jul. 26, 1991 [JP] Japan ..... 3-186753

[51] Int. Cl.[5] ..... G05F 3/20

[52] U.S. Cl. ..... 323/315; 323/312; 323/901; 323/907

[58] Field of Search ..... 323/901, 312, 315, 316, 323/907; 307/296.1, 296.6

[56] References Cited

U.S. PATENT DOCUMENTS 4,051,392 9/1977 Rosenthal et al. ..... 323/901
4,618,816 10/1986 Monticelli ..... 323/312
4,833,344 5/1989 Moon et al. ..... 323/312

*Primary Examiner*—Steven L. Stephan
*Assistant Examiner*—Ben M. Davidson
*Attorney, Agent, or Firm*—Sughrue, Mion, Zinn, Macpeak & Seas

[57] ABSTRACT

A constant-current source including a constant-current output circuit for supplying a constant current provided with one or more transistors with the bases biased with the same base potential, a first circuit which provides a first current signal for setting the strength of the constant current to be delivered from the constant-current output circuit, a second circuit which generates a second current signal and provides the same base potential in response to the second current signal, a third circuit which controls the second current signal to minimize any deviation of the second current signal from the first current signal, and a DC power supply for energizing at least the first, second and third circuits. The improvement is that the transconductance of the first circuit which represents the ratio of a change in the first current signal to a change in the output voltage of the DC power supply is equal to the transconductance of the second circuit which represents the ratio of a change in the second current signal to a change in the output voltage of the DC power supply.

4 Claims, 3 Drawing Sheets

CONSTANT-CURRENT SOURCE

BACKGROUND OF THE INVENTION

1. Field of the Invention

The present invention relates to a DC constant-current source, and in particular to a DC constant-current source capable of compensating for errors in the output current caused by changes in the output voltage of the DC power supply.

2. Description of the Related Art

Various types of circuits for constant-current source have been developed as needed. FIGS. 1 and 2 show circuits of first and second prior-art constant-current sources, respectively, which are of our present interest.

The circuit shown in FIG. 1 is provided with DC power supply 2, output-current setting circuit 13, current regulating circuit 14 made up of pnp transistor $Q_4$ and resistor $R_4$, a current-difference amplifier made up of pnp transistor $Q_8$ and resistor $R_8$, and constant-current output circuit 5.

Constant-current output circuit 5 (hereafter referred to as output circuit 5) is made up of a plurality of pnp transistors $Q_{16}$, ---, $Q_{n-1}$, $Q_n$ of the same characteristics with the bases interconnected through a base line and the emitters connected to the positive electrode of DC power supply 2 through emitter resistors $R_{16}$, ---, $R_{n-1}$, $R_n$ of the same resistance.

Output-current setting circuit 13, driven by DC power supply 2, generates a current signal $I_{C2}$ (the collector current of transistor $Q_2$). The current output of output circuit 5 is regulated to a value which corresponds to reference current $I_{C2}$, as will be described below.

Circuit 13 includes a series circuit composed of resistor $R_{3A}$, temperature-compensated npn transistor $Q_1$ and constant-voltage source 1 connected in series between the positive and grounded negative electrodes of DC power supply 2. Constant-voltage source 1 supplies transistor $Q_1$ with constant emitter potential $V_1$ with respect to the ground potential. Transistor $Q_1$ serves to provide base potential $V_{B1}$ for biasing the base of transistor $Q_2$, $V_{B1}$ being $V_1+V_{BE1}$ and $V_{BE1}$ being the base-emitter voltage of transistor $Q_1$. Resistor $R_{3A}$ is determined according to approximate equation $R_{3A}=(V_2-V_1)/I_{3A}$, where $V_2$ and $I_{3A}$ represent the output voltage of DC power supply 2 and a prescribed current which flows through Resistor $R_{3A}$. Npn transistor $Q_9$ supplies a fraction of its current output to transistor $Q_1$ as base current $I_{B1}$ so as to minimize any deviation of collector current $I_{C1}$ of transistor $Q_1$ from current $I_{3A}$, i.e. to minimize base current $I_{B9}=I_{3A}-I_{C1}$ of transistor $Q_9$. This allows the deviation to be regulated to $I_{3A}/(f \cdot h_{FE1} \cdot h_{FE9})$, an order of $10^{-4} \cdot I_{3A}$, where $h_{FE1}$ and $h_{FE9}$ represent the current gains of transistor 1 and 9, respectively, and f denotes a fraction of the emitter current of transistor $Q_9$ that is supplied to the base of transistor $Q_1$.

Transistor $Q_2$ has an emitter grounded through resistor $R_2$ and is biased with the same base potential as that of transistor $Q_1$. This causes the emitter potential of transistor $Q_2$ to equal that of transistor $Q_1$, provided that the difference in the base-emitter voltages of the two transistors, $\Delta B_{BE}$, is ignored. As a result, the emitter current $I_{E2}$ of transistor $Q_2$, thus collector current $I_{C2}$, becomes approximately $V_1/R_2$. In this way, collector current $I_{C2}$, which is an output of output-current setting current 13, is set to a desired value by adjusting resistor $R_2$. Transistor $Q_2$ is also temperature-compensated so that a change in collector current $I_{C2}$ caused by a temperature change in transistor $Q_1$ will be compensated for. The advantage of output-current setting circuit 13 is that it is capable of establishing a current of a given strength with a smallsized circuitry.

Transistor $Q_4$ and emitter resistor $R_4$ constitute an amplifier identical with each of the parallel amplifiers constituted by transistors $Q_{16}$, $Q_{17}$ ---, $Q_n$ and their emitter resistors $R_{16}$, $R_{17}$, ---, $R_n$. The base of transistor $Q_4$ is connected both to the bases of the group of transistors $Q_{16}$, ---, $Q_{n-1}$, $Q_n$ and to the collector of transistor $Q_4$ by way of transistor $Q_8$ to constitute a current-mirror circuit, wherein transistor $Q_4$ is the input transistor and the group of transistors $Q_{16}$, ---, $Q_{n-1}$ and $Q_n$ are the output transistors. The collector of transistor $Q_4$ is also connected to the collector of transistor $Q_2$ through a branch point where difference current $I_{B8}=I_{C2}-I_{C4}$, which corresponds to the deviation of collector current $I_{C4}$ of transistor $Q_4$ from collector current $I_{C2}$, is branched off.

Transistor $Q_8$, associated with resistor $R_8$, provides a path of the base currents of the group of transistors $Q_{16}$, ---, $Q_{n-1}$, $Q_n$ and of transistor $Q_4$. Transistor $Q_8$ also acts to control emitter current $I_{E4}$ of transistor $Q_4$ so as to minimize difference current $I_{B8}$ by the same operation as transistor 9.

When the output current of output circuit 5 decreases, base potential $V_{BG}$ of the group of transistors $Q_{16}$, ---, $Q_{n-1}$, $Q_n$ is raised. Since the base of transistor $Q_4$ is voltage-biased by base potential $V_{BG}$, the rise in base potential $V_{BG}$ causes a decrease in emitter current $I_{E4}$ of transistor $Q_4$, which results in an increase in base current $I_{B8}$ of transistor $Q_8$. Transistor $Q_8$ acts to carry more collector current $I_{C8}$, which causes base potential $V_{BG}$ to be lowered, whereby emitter current $I_{E4}$ increases to minimize base current $I_{B8}$, i.e. to minimize the deviation of $I_{C4}$ from $I_{C2}$. Since emitter current $I_{E4}$ is an input of the currentmirror circuit, the increase in $I_{E4}$ causes the output current of the current-mirror circuit, i.e. output current $I_o$ of output circuit 5. Thus, output current $I_o$ is regulated to the value corresponding to collector current $I_{C2}$. In this way, collector current $I_{C2}$ serves as a reference current to be referred to by collector current $I_{C4}$.

Next, referring to FIG. 2, a second constant-current source of the prior art will be explained. The essential part of the constant-current source is identical with that of the first constant-current source shown in FIG. 1. The difference is in output-current setting circuit 10. In constant-current setting circuit 10, reference current $I_r$ is established by applying a constant voltage $V_1$ across resistor $R_2$ through negative feedback amplifier 11 of voltage gain 1 (a voltage follower) which serves as a buffer circuit. Reference current $I_r$ is determined from equation $I_r=V_1/R_2$, as is the case in the first constant-current source.

The operation of the circuit shown in FIG. 2 to stabilize output current $I_o$ is similar to that shown in FIG. 1.

A problem in the first constant-current source above has been that it is susceptible to changes in the output voltage of DC power supply 2. Let $\Delta V_2$ be the change, and $g_{m1}$, $g_{m2}$ the transconductances of transistors $Q_1$, $Q_2$, respectively, then change $\Delta I_{C2}$ in collector current $I_{C2}$ caused by $\Delta V_2$ becomes $(\Delta V_2/R_{3A})$ $(g_{m2}/g_{m1})$, which entails a change in output current $I_o$ of the constant-current source. Further, another problem has been that, while transistor $Q_1$ and $Q_2$ are temperature-compensated, output-current setting circuit 13 as a whole is susceptible to temperature changes.

A problem in the second constant-current source above has been that the buffer amplifier, i.e. negative feedback amplifier 11, requires a large size.

SUMMARY OF THE INVENTION

It is an object of the present invention to provide a constant-current source capable of compensating for changes in the output current of the constant current source caused by changes in the output voltage of the DC power supply.

It is another object of the present invention to provide a small-sized constant-current source capable of compensating for changes in the output current of the constant current source caused by both changes in the output voltage of the DC power supply and changes in temperature of the circuit.

In order to attain the first object above, the constant-current source according to the present invention includes a constant-current output circuit for supplying a constant current provided with one or more transistors with the bases biased with the same base potential, a first circuit which provides a first current signal for setting the strength of the constant current to be delivered from the constant-current output circuit, a second circuit which generates a second current signal and provides said same base potential in response to the second current signal, a third circuit which controls the second current signal to minimize any deviation of the second current signal from the first current signal, and a DC power supply for energizing at least the first, second and third circuits, wherein the transconductance of the first circuit which represents the ratio of a change in the first current signal to a change in the output voltage of the DC power supply is equal to the transconductance of the second circuit which represents the ratio of a change in the second current signal to a change in the output voltage of the DC power supply.

Since the two transconductances equal each other, changes in the first and second current signals caused by an output-voltage change of the DC power supply are the same. Thus, the output voltage change does not exert any effect on controlling the second current signal by the third circuit, whereby the output current of the current output circuit will not be affected by the output voltage change of the DC power supply.

The first circuit preferably comprises a first resistance connected to a first electrode of the DC power supply at one end thereof, a first transistor of a first conductivity type with its emitter connected to the other end of the first resistance and with its base circuit arranged so as to be insusceptible to any change in the output voltage of the DC power supply, a constant voltage source with the second electrode connected to the second electrode of the DC power supply, a second transistor of a second conductivity type with the emitter connected to a first electrode of the constant voltage source and the collector connected to the collector of the first transistor through a branch point where a difference current corresponding to a deviation of the collector current of the second transistor from the collector current of the first transistor is branched off, a regulation circuit which supplies a base current to the second transistor so as to minimize the deviation, a second resistance connected to the second electrode of the constant voltage source at one end thereof, and a third transistor of the second conductivity type with the emitter connected to the other end of the second resistance, the base connected to the base of the second transistor and the collector connected to the second circuit, the second circuit comprises a third resistance connected to the first electrode of the DC power supply, and a fourth transistor of the first conductivity type with the emitter connected to the other end of the third resistance, the base connected to the base of each transistor in the constant-current output circuit and the collector connected to the collector of the third transistor through a branch point where a difference current corresponding to the deviation of the collector current of the fourth transistor from the collector current of the third transistor is branched to be supplied to the third circuit, wherein the first resistance is determined such that the ratio of the first resistance to the third resistance equals the reciprocal of the ratio of the collector current of the first transistor to the collector current of the third transistor, and the first, second, third and fourth transistors have transconductances such that the ratio of the transconductance of the fourth transistor to that of the first transistor is equal to the ratio of the transconductance of the third transistor to that of the second transistor.

In order to effect temperature-compensation of the ratio of the transconductance of the fourth transistor to that of the first transistor, and of the ratio of the transconductance of the third transistor to that of the second transistor, it is preferable that the current densities of the emitter currents carried by the first and fourth transistors be equal, and that the current densities of the emitter currents carried by the second and third transistors also be equal.

The above and other objects, features and advantages of the present invention will become apparent from the following description referring to the accompanying drawing which illustrates an example of a preferred embodiment of the present invention.

DETAILED DESCRIPTION OF PREFERRED EMBODIMENT

Figure 1:
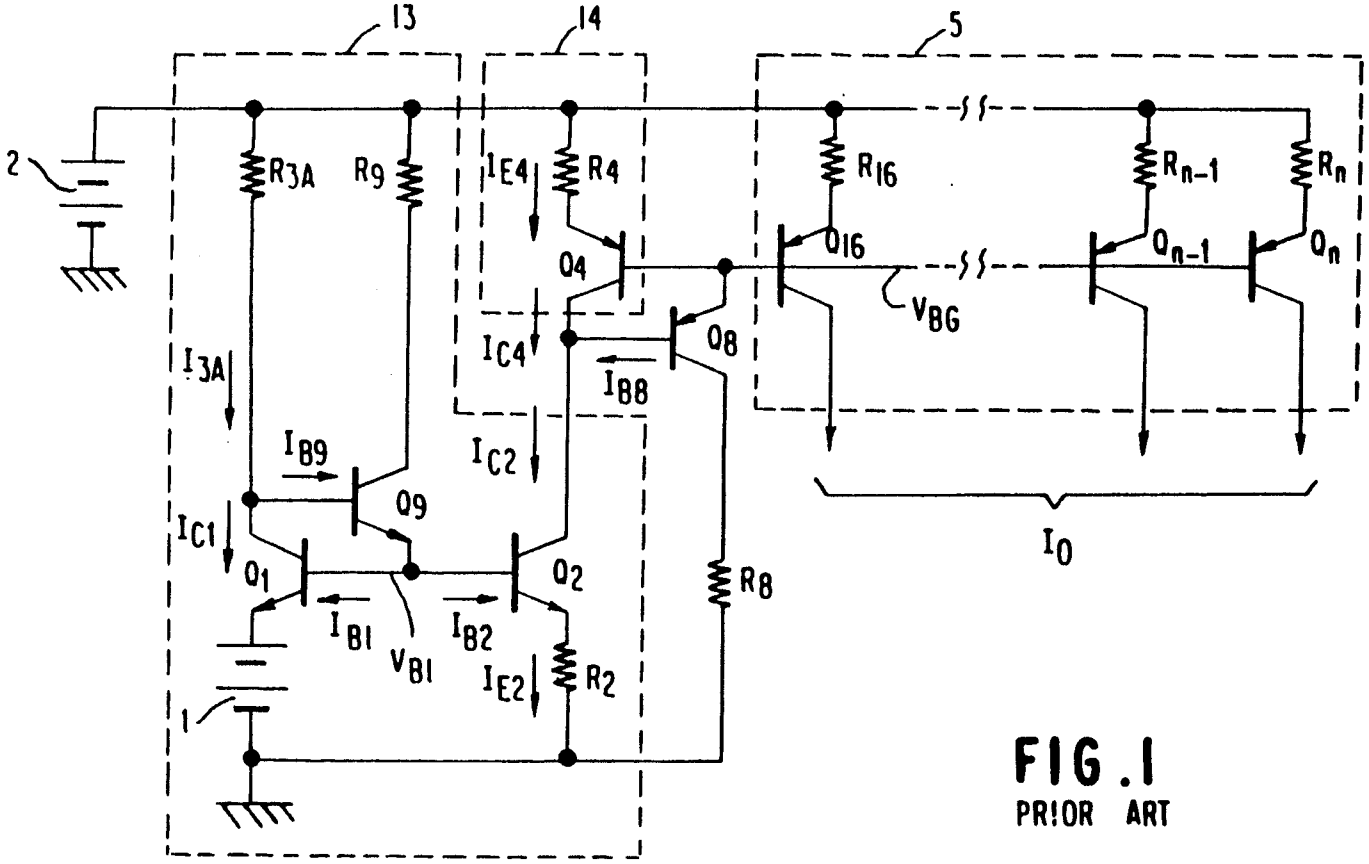
FIG. 1 PRIOR ART
FIG. 1 shows a circuit of a first constant-current source according to the prior art.
Figure 2:
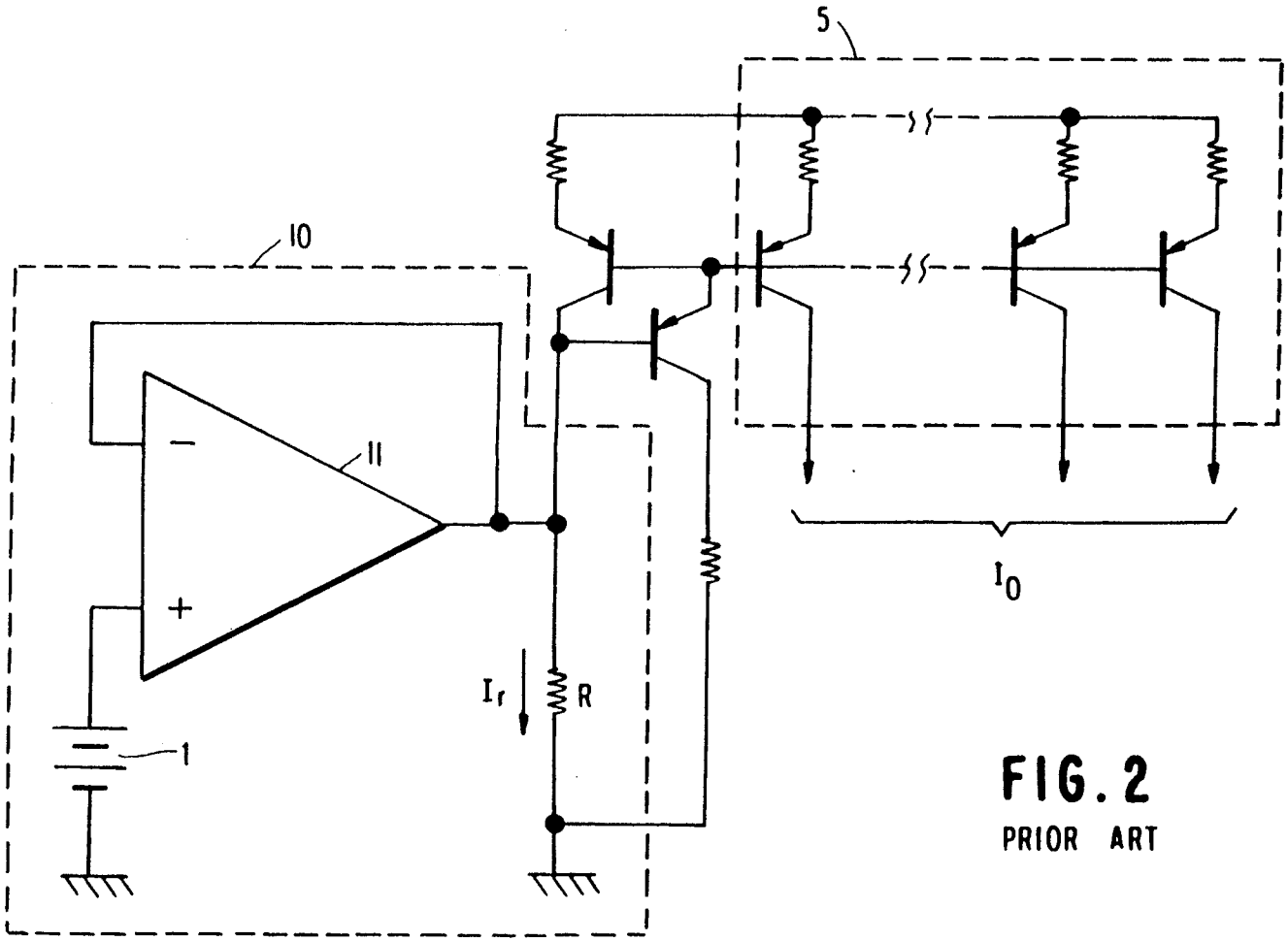
FIG. 2 PRIOR ART
FIG. 2 shows a circuit of a second constant-current source according to the prior art.
Figure 3:
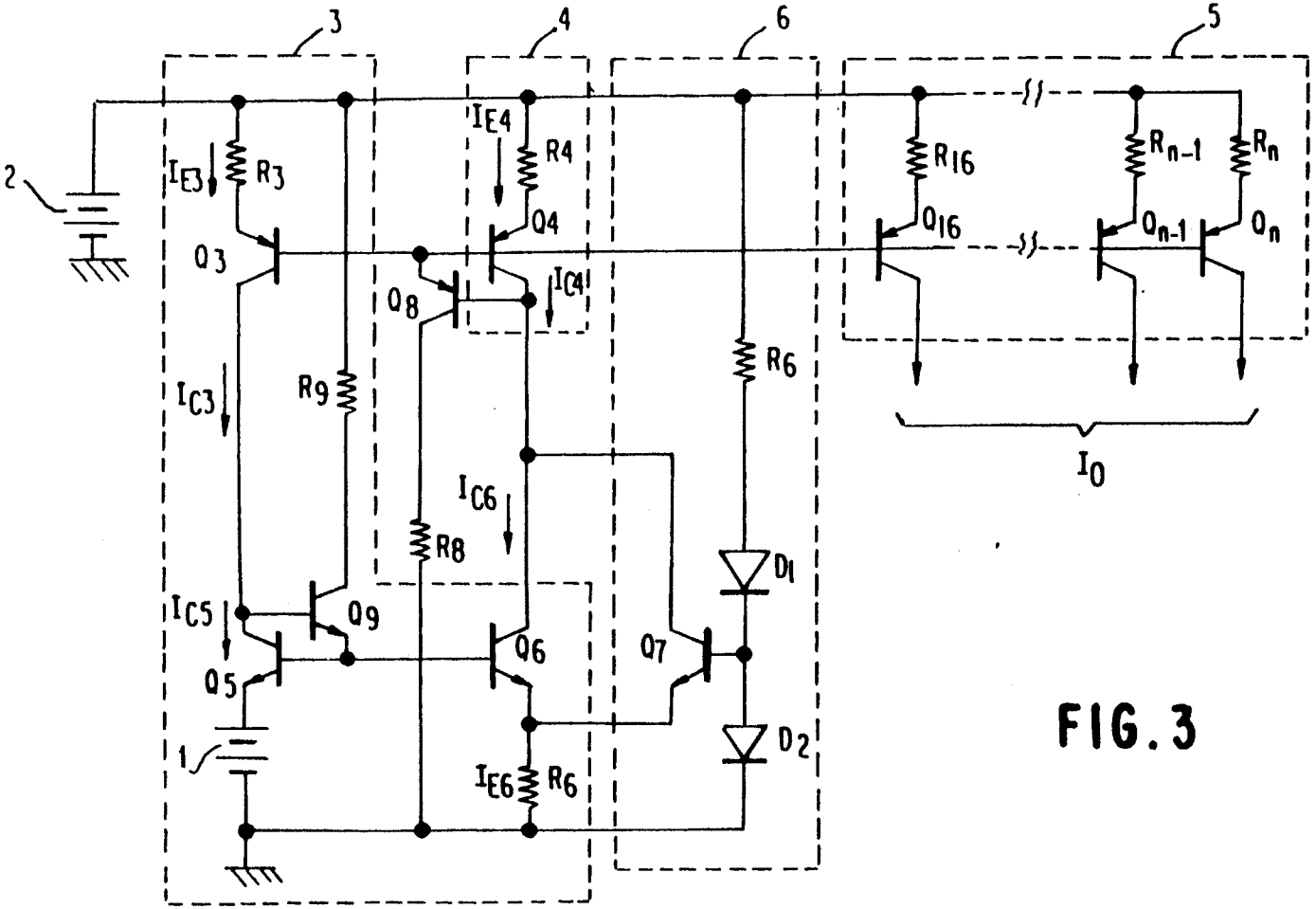
FIG. 3 shows a circuit of the constant-current source according to the present invention.

Referring now to FIG. 3, an embodiment of the present invention will be explained below. Like the circuit shown in FIG. 1, the circuit of the constant-current source according to the present invention comprises DC power supply 2, output-current setting circuit 3, constant-current output circuit 5 (hereafter referred to as output circuit 5), current regulating circuit 4 made up of pnp transistor $Q_4$ and emitter resistor $R_4$, a current-difference amplifier made up of pnp transistor $Q_8$ and resistor $R_8$, and starter circuit 6. Among these, the current regulating circuit, the current-difference amplifier and output circuit 5 are identical with those in the circuit shown in FIG. 1. Accordingly transistor $Q_4$ and each of transistor $Q_{16}$, ---, $Q_{n-1}$, $Q_n$ have identical characteristics, and emitter resistor $R_4$ and each of emitter resistors $R_{16}$, ---, $R_{n-1}$, $R_n$ have the same resistance, so that transistor $Q_4$ and each of transistors $Q_{16}$, ---, $Q_{n-1}$, $Q_n$ carry currents of the same current density, thereby constituting a current mirror circuit.

The differences between output-current setting circuits 3 and 13 are that, in lieu of resistor $R_{3A}$ in output-current setting circuit 13, transistor $Q_3$ and emittor resistor $R_3$ are arranged in output-current setting circuit 3, that the ratio of resistance $R_3$ to resistor $R_4$ equals a reciprocal of the ratio of a prescribed value of emitter current $I_{E3}$ of transistor $Q_3$ to a prescribed value of emitter current $I_{E6}$ of transistor $Q_6$, and that both the ratio of emitter area $S_3$ of transistor $Q_3$ to emitter area $S_4$ of transistor $Q_4$ and the ratio of the emitter area $S_5$ of transistor $Q_5$ to emitter area $S_6$ of transistor $Q_6$ are equal to the ratio of emitter current $I_{E3}$ to emitter current $I_{E6}$. The base circuit of transistor 3 is arranged so that any output-voltage change of DC power supply 2 will not affect the base potential. In the present embodiment the base of transistor $Q_3$ is connected to the base of transistor $Q_4$.

By the arrangement described above, substantially the same voltage as the voltage across resistor $R_4$ is applied across resistor $R_3$, causing the emitter potential of transistor $Q_3$ with respect to the positive electrode of DC power supply 2 to be the same as the emitter potential of transistor $Q_4$. Further, since collector currents $I_{C5}$ and $I_{C4}$ of transistors $Q_5$ and $Q_4$ are regulated to approach collector current $I_{C3}$ and $I_{C6}$ of transistor $Q_3$ and $Q_6$, respectively, the current densities of the emitter currents in transistors $Q_3$, $Q_5$ are substantially equal to those in transistors $Q_4$, $Q_6$ respectively, in the stable state of the constant-current source.

As is well known in the art, when two transistors, say $Q_3$ and $Q_4$, in a monolithic IC carry emitter currents of the same current density, the difference between the base-emitter voltages, $\Delta VBE = V_{BE3} - V_{BE4}$, and its temperature coefficient $\delta\Delta V_{BE}/\delta T$ vanishes. (This is because all factors except the emitter areas in the reverse saturation currents are equal in the transistors provided in a given monolithic IC, and thus the reverse saturation current is a function of a single emitter area.) Since the ratio of transconductance $g_{m3}$ of transistor $Q_3$ to the transconductance $g_{m4}$ of transistor $Q_4$ is $$\frac{g_{m3}}{g_{m4}} = \frac{S_3}{S_4} \exp \frac{V_{BE3} - V_{BE4}}{V_T}, \tag{1}$$

$$\delta\left(\frac{g_{m3}}{g_{m4}}\right)/\delta T = -\frac{S_3}{S_4} \frac{q}{kT^2} (V_{BE3} - V_{BE4}) \times \exp \frac{V_{BE3} - V_{BE4}}{V_T}, \tag{2}$$

and since $V_{BE3} - V_{BE4} = 0$ under the equal current-density condition, it follows from equations (1) and (2) that $$\frac{g_{m3}}{g_{m4}} = \frac{S_3}{S_4} \tag{3}$$

$$\delta\left(\frac{g_{m3}}{g_{m4}}\right)/\delta T = 0. \tag{4}$$

As described above, since $$\frac{S_3}{S_4} = \frac{S_5}{S_6}, \tag{5}$$

it follows that $$\frac{g_{m3}}{g_{m4}} = \frac{g_{m5}}{g_{m6}}. \tag{6}$$

Augments similar to those setforth in equations (1), (2) and (4) hold in $g_{m5}/g_{m6}$. Therefore equation (6) is temperature-compensated in the sense that equation (6) holds in the case that the temperature changes as well.

Suppose that due to an output voltage change of DC power supply 2, $V_{BE3}$ and $V_{BE4}$ change by $\Delta V_{BE3}$ and $\Delta V_{BE4}$, respectively. Since under the equal current-density condition, $$\Delta(V_{BE3} - V_{BE4}) = \Delta V_{BE3} - \Delta V_{BE4} = 0, \text{ and} \tag{7}$$

since $$\Delta V_{BE3} = \frac{\Delta I_{C3}}{g_{m3}}, \text{ and } \Delta V_{BE4} = \frac{\Delta I_{C4}}{g_{m4}}, \tag{8}$$

$$\Delta I_{C4} = \left(\frac{g_{m4}}{g_{m3}}\right)\Delta I_{C3}. \tag{9}$$

Similarly, with regard to transistors $Q_5$ and $Q_6$ $$\Delta I_{C6} = (g_{m6}/g_{m5})\, \Delta I_{C5} = (g_{m6}/g_{m5})\, \Delta I_{C3} \tag{10}$$

From equations (9), (10) and (6) it follows that $$\Delta I_{B8} = \Delta(I_{C6} - I_{C4}) = 0. \tag{3}$$

Thus, a change in the output voltage in DC power supply 2 does not exert any effect on base current $I_{B8}$ of transistor $Q_8$. Consequently, the base currents of transistors $Q_{16}$, ---, $Q_{n-1}$, $Q_n$, and thus the output current of the constant-current source are not subject to any adverse effect caused by any output change of the DC power supply.

It should be appreciated that, since the temperature coefficients of both sides of equation (6) vanish under the equal current-density condition, as described above, the circuit shown in FIG. 3 is temperature-compensated, and that this circuit can be realized in a small size.

Starter circuit 6 comprises resistor $R_6$, diodes $D_1$ and $D_2$ connected in series between the electrodes of DC power supply 2 and npn transistor $Q_7$ with the base connected between diodes $D_1$ and $D_2$, and with the emitter and collector connected with the emitter and collecter of transistor $Q_6$, respectively.

At start-up time, when the base potential of transistor $Q_7$ rises above that of transistor $Q_6$, transistor $Q_7$ turns on, whereby collector-emitter voltage $V_{CE4}$ of transistor $Q_4$ is established. Collector-emitter voltage $V_{CE4}$ allows the emitter-base junctions in transistors $Q_4$ and $Q_8$ to be forwardly biased in series, whereby the base potentials of transistors $Q_4$ and $Q_3$ are established, allowing transistor $Q_3$ to turn on. The turn-on of transistor $Q_3$ allows the base-emitter junctions in transistors $Q_9$ and $Q_5$ to be forwardly biased in series, whereby the base potentials of transistors $Q_5$ and $Q_6$ are established. When the base potential of transistor $Q_6$ rises above that of transistor $Q_7$, transistor $Q_7$ is cut off, and the whole circuit of the constant-current source starts to operate. After startup, transistor $Q_8$ acts so as to minimize $I_{C6}-I_{C4}$. Since transistor $Q_4$ and the group of transistors $Q_{16}$, ---, $Q_{n-1}$, $Q_n$ constitute a current mirror circuit, current output $I_o$ of output circuit 5 is regulated so that the collector current of each of transistors $Q_{16}$, ---, $Q_{n-1}$, $Q_n$ equals collector current $I_{C6}$, the reference current.

In the above embodiment, the base of transistor $Q_3$ is connected to that of transistor $Q_4$ in order to make clear the basic concept of the present invention. However, it is not always necessary to do so. The thing to be noted is that the base circuit of transistor $Q_3$ is arranged so as not to be directly affected by any change in the output voltage of DC power supply 2. For example, transistor $Q_3$ may be collector-to-base shorted, or diode-connected.

Further, in the case that it is required to compensate for changes in the output current due to changes only in the output voltage of the DC power supply, any circuit will do in which the transconductance which represents the ratio of the change in the output of the output-current setting circuit to the change in the output voltage of the DC power supply equals the transconductance which represents the ratio of the change in the output of the current regulating circuit to the change in the output voltage of the DC power supply.

It is to be understood that although characteristics and advantages of the present invention have been set forth in the foregoing description, the disclosure is illustrative only, and changes may be made in arrangement of parts within the scope of the appended claims.

What is claimed is:

1. A constant-current source comprising:

a constant-current output circuit for supplying a constant current provided with one or more transistors having bases interconnected through a base line, a first circuit which provides a first current signal for setting a strength of the constant current to be delivered from the constant-current output circuit, a second circuit which generates a second current signal in response to a potential of the base line, a third circuit which operates to minimize any deviation of the second current signal from the first current signal, causing the potential of the base line to change, and a DC power supply for energizing at least the first, second and third circuits, wherein the first circuit comprises:

a first resistance connected to a first electrode of the DC power supply at one end thereof, a first transistor of a first conductivity type having an emitter connected to the other end of the first resistance and a base connected to the base line, a constant voltage source having a second electrode connected to a second electrode of the DC power supply, a second transistor of a second conductivity type having an emitter connected to a first electrode of the constant voltage source and a collector connected to a collector of the first transistor through a branch point where a difference current corresponding to a deviation of the collector current of the second transistor from the collector current of the first transistor is branched, a regulation circuit which supplies a base current to the second transistor so as to minimize the deviation, a second resistance connected to the second electrode of the constant voltage source at one end thereof, and a third transistor of the second conductivity type having an emitter connected to the other end of the second resistance, a base connected to the base of the second transistor and a collector connected to the second circuit, wherein the second circuit comprises:

a third resistance connected to the first electrode of the DC power supply at one end thereof, and a fourth transistor of the first conductivity type having an emitter connected to the other end of the third resistance, a base connected to the base of each transistor in the constant-current output circuit through the base line forming a current-mirror circuit and a collector connected to the collector of the third transistor through a branch point where a difference current corresponding to a deviation of the collector current of the fourth transistor, which is the second current signal, from the collector current of the third transistor, which is the first current signal, is branched to be supplied to the third circuit, the first resistance being determined so that a ratio of the first resistance to the third resistance equals a reciprocal of a ratio of the collector current of the first transistor to the collector current of the third transistor, and the first, second, third and fourth transistors having such transconductances that the ratio of the transconductance of the fourth transistor to that of the first transistor is equal to the ratio of the transconductance of the third transistor to that of the second transistor.

2. A constant-current source according to claim 1, wherein the current densities of the emitter currents in the first and fourth transistors are made equal, and the current densities of the emitter currents in the second and third transistors are made equal.

3. A constant-current source according to claim 1, further comprising a starter circuit for starting up the constant-current source, wherein the starter circuit comprises a start-up transistor of the same conductivity type as that of the third transistor and biasing means for providing a base potential to the start-up transistor, the start-up transistor having a collector connected with the collector of the third transistor and an emitter connected with the junction of the emitter of the third transistor and the second resistance, the biasing means providing a constant base potential with respect to the potential of the second electrode of the constant voltage source such that an absolute value of the constant base potential is larger than an absolute value of a base potential of the third transistor at a start-up time of the constant-current source and is less than that of the third transistor at a time after the start-up of the constant-current source ends.

4. A constant-current source according to claim 1, wherein a ratio of emitter areas of the first, second, third and fourth transistors equals a ratio of the transconductances of the first, second, third and fourth transistors.

* * * * *